US008454292B2

(12) United States Patent
Saucedo et al.

(10) Patent No.: US 8,454,292 B2
(45) Date of Patent: Jun. 4, 2013

(54) METHOD OF FORMING A CAN END HAVING A MOVEABLE PORTION

(75) Inventors: Alejandro Saucedo, Chicago, IL (US); William A. Kirk, Massillon, OH (US); Henry S. Chorzempa, Lemont, IL (US); Danny L. Fundom, Massillon, OH (US)

(73) Assignee: Crown Packaging Technology, Inc., Alsip, IL (US)

( * ) Notice: Subject to any disclaimer, the term of this patent is extended or adjusted under 35 U.S.C. 154(b) by 253 days.

(21) Appl. No.: 12/465,894

(22) Filed: May 14, 2009

(65) Prior Publication Data

US 2010/0287886 A1 Nov. 18, 2010

(51) Int. Cl.
*B21D 51/44* (2006.01)

(52) U.S. Cl.
USPC ..... 413/8; 413/56; 72/348

(58) Field of Classification Search
USPC ..... 72/347–349; 413/8, 56
See application file for complete search history.

(56) References Cited

U.S. PATENT DOCUMENTS

| | | | |
|---|---|---|---|
| 2,261,117 | A | 11/1941 | Jack |
| D200,021 | S | 1/1965 | Bozek |
| 3,369,689 | A | 2/1968 | Dodge |
| 3,404,801 | A | 10/1968 | Silver |
| 3,477,608 | A | 11/1969 | Fraze |
| D219,370 | S | 12/1970 | Saunders |
| 3,559,843 | A | 2/1971 | Kern |
| D221,930 | S | 9/1971 | Saunders |
| 3,643,833 | A | 2/1972 | Fraze et al. |
| 3,662,916 | A | 5/1972 | Holk |
| D224,209 | S | 7/1972 | Kinkel et al. |
| 3,674,171 | A | 7/1972 | Fahlbusch |
| D226,071 | S | 1/1973 | Saunders |
| D226,073 | S | 1/1973 | Wesphal |
| 3,724,709 | A | 4/1973 | Westphal |
| 3,744,662 | A | 7/1973 | Zundel |
| 3,762,596 | A | 10/1973 | Henning et al. |
| 3,779,417 | A | 12/1973 | Klein |
| 3,838,788 | A | 10/1974 | Stargell |
| 3,905,513 | A | 9/1975 | Klein |
| 3,929,251 | A | 12/1975 | Urmston |

(Continued)

FOREIGN PATENT DOCUMENTS

| | | |
|---|---|---|
| EP | 0088185 | 9/1983 |
| EP | 1919786 | 5/2008 |

(Continued)

OTHER PUBLICATIONS

"Advertisement for Boa Housewares', Canpull", The Canmaker, Jun. 2002, vol. 15, 3 pages.
"Advertisement for Buhrke Tech's New End Opens Easier and Costs Less to Make", The Canmaker, Jan. 1998, vol. 11, 6 pages.
"Cannex Asia's Seamlingly Endless Possibilities", The Canmaker, Feb. 2003, vol. 16, 3 pages.

(Continued)

*Primary Examiner* — M. Alexandra Elve
*Assistant Examiner* — Eyamindae Jallow
(74) *Attorney, Agent, or Firm* — Woodcock Washburn LLP

(57) ABSTRACT

Methods for producing a can end having a moveable portion disposed beneath a tab are disclosed. In one embodiment, a can end having a center panel may be formed. A moveable portion may be formed in the center panel. The moveable portion may be in a downward position after it is formed. The can end may then be restrained such that a portion of the center panel that is adjacent to the moveable portion is unrestrained. While the can end is restrained, the moveable portion may be moved into an upward position.

5 Claims, 13 Drawing Sheets

U.S. PATENT DOCUMENTS

| | | | | | |
|---|---|---|---|---|---|
| 3,930,592 | A | | 1/1976 | Dilanni | |
| 3,938,696 | A | | 2/1976 | Herbst | |
| 3,941,277 | A | | 3/1976 | McKinney et al. | |
| 3,951,299 | A | | 4/1976 | Khoury | |
| D243,833 | S | | 3/1977 | Markert | |
| 4,030,631 | A | | 6/1977 | Brown | |
| 4,150,777 | A | | 4/1979 | Cyr et al. | |
| 4,205,760 | A | | 6/1980 | Hasegawa | |
| 4,252,247 | A | | 2/1981 | Asbury | |
| 4,266,688 | A | | 5/1981 | Reid | |
| D263,803 | S | | 4/1982 | Fraze | |
| 4,333,581 | A | | 6/1982 | Flansburg | |
| 4,361,244 | A | | 11/1982 | Walter | |
| 4,369,888 | A | | 1/1983 | Walter | |
| 4,397,400 | A | | 8/1983 | Walter | |
| 4,442,950 | A | | 4/1984 | Wilson | |
| 4,463,866 | A | | 8/1984 | Mandel | |
| 4,503,989 | A | | 3/1985 | Brown et al. | |
| D278,980 | S | | 5/1985 | Brown et al. | |
| 4,559,729 | A | | 12/1985 | White | |
| 4,571,978 | A | * | 2/1986 | Taube et al. | 72/349 |
| 4,701,090 | A | | 10/1987 | Smith | |
| 4,716,755 | A | * | 1/1988 | Bulso et al. | 72/349 |
| 4,722,215 | A | * | 2/1988 | Taube et al. | 72/349 |
| 4,747,511 | A | | 5/1988 | Dutt et al. | |
| D307,720 | S | | 5/1990 | Saunders | |
| 5,011,037 | A | | 4/1991 | Moen et al. | |
| D321,326 | S | | 11/1991 | Harwood | |
| 5,064,087 | A | | 11/1991 | Koch | |
| D332,402 | S | | 1/1993 | Harwood et al. | |
| 5,199,618 | A | | 4/1993 | Reil et al. | |
| 5,307,947 | A | | 5/1994 | Moen et al. | |
| 5,335,808 | A | | 8/1994 | Lee | |
| 5,502,995 | A | * | 4/1996 | Stodd | 72/336 |
| 5,622,273 | A | | 4/1997 | Kelly | |
| 5,671,860 | A | | 9/1997 | Louwerse et al. | |
| 5,685,189 | A | * | 11/1997 | Nguyen et al. | 72/348 |
| 5,743,445 | A | | 4/1998 | Bennarrouch | |
| 5,749,257 | A | * | 5/1998 | McEldowney | 72/354.6 |
| 5,804,237 | A | | 9/1998 | Diamond et al. | |
| 5,813,561 | A | | 9/1998 | Chang et al. | |
| 5,947,317 | A | | 9/1999 | Hall | |
| 6,024,239 | A | * | 2/2000 | Turner et al. | 220/269 |
| 6,059,137 | A | | 5/2000 | Westwood et al. | |
| 6,089,072 | A | * | 7/2000 | Fields | 72/379.4 |
| 6,105,806 | A | | 8/2000 | Stasiuk | |
| D432,015 | S | | 10/2000 | Holiday | |
| 6,138,856 | A | | 10/2000 | Ghim et al. | |
| 6,206,220 | B1 | | 3/2001 | Stodd | |
| 6,290,447 | B1 | * | 9/2001 | Siemonsen et al. | 413/56 |
| 6,427,861 | B1 | | 8/2002 | Cho | |
| 6,702,538 | B1 | * | 3/2004 | Heinicke et al. | 413/8 |
| 7,168,586 | B2 | | 1/2007 | Jeon | |
| 7,174,762 | B2 | * | 2/2007 | Turner et al. | 72/348 |
| 7,305,861 | B2 | * | 12/2007 | Turner et al. | 72/348 |
| 7,341,163 | B2 | * | 3/2008 | Stodd | 220/623 |
| D565,406 | S | | 4/2008 | Foskett | |
| D568,741 | S | | 5/2008 | Foskett | |
| 7,407,061 | B2 | | 8/2008 | Fares et al. | |
| 7,500,376 | B2 | * | 3/2009 | Bathurst et al. | 72/348 |
| 7,617,945 | B2 | | 11/2009 | Cherian | |
| 8,104,319 | B2 | * | 1/2012 | Turner et al. | 72/348 |
| 2004/0259235 | A1 | | 12/2004 | Fares et al. | |
| 2005/0150889 | A1 | | 7/2005 | Perra | |
| 2007/0068943 | A1 | | 3/2007 | Ramsey | |
| 2007/0108209 | A1 | | 5/2007 | Jeon et al. | |
| 2007/0215620 | A1 | | 9/2007 | Kasper | |
| 2008/0314906 | A1 | * | 12/2008 | Butcher et al. | 220/272 |
| 2010/0021270 | A1 | * | 1/2010 | McEldowney et al. | 413/25 |

FOREIGN PATENT DOCUMENTS

| | | |
|---|---|---|
| EP | 2075199 | 7/2009 |
| EP | 1964784 | 4/2010 |
| EP | 1958882 | 7/2010 |
| FR | 2826939 | 1/2003 |
| GB | 23 200 08 A | 6/1998 |
| JP | 61-48128 | 3/1986 |
| JP | 2003-054549 | 2/2003 |
| JP | 2003-112735 | 4/2003 |
| KR | 10-2000-17742 | 4/2000 |
| NL | 7416818 | 7/1975 |
| WO | WO 01/28875 | 4/2001 |
| WO | WO 02/08074 | 1/2002 |
| WO | WO 03/104092 | 12/2003 |
| WO | WO 2007/039367 | 4/2007 |
| WO | WO 2009/090171 | 7/2009 |
| WO | WO 2010/026019 | 3/2010 |

OTHER PUBLICATIONS

"Contains 100% of Your Daily EOE Requirements", The Canmaker, Jul. 2000, vol. 13, 3 pages.
"Heinz Takes The Easy Way", The Canmaker, Jun. 1999, vol. 12, 6 pages.
"HL Foods Chooses Easy-Open Ends", The Canmaker, Nov. 1999, vol. 12, 5 pages.
"Impress Grabs Heinz Contract", The Canmaker, Jul. 1999, vol. 12, 6 pages.
"Interesting Openings, Part 3", The Canmaker, Sep. 1999, vol. 12, 3 pages.
"Modelling Helps Easy-Open End Choice", The Canmaker, Apr. 2003, vol. 16, 3 pages.
"New Generation of Easy Open Ends", The Canmaker, Oct. 1998, vol. 11, 3 pages.
"Stacking Giant in France", The Canmaker, Mar. 1998, vol. 11, 3 pages.
"Tab Orientation for Better Easy-Open Performance", The Canmaker, May 2001, vol. 14, 3 pages.
"The Ergonomic and Hygienic Can-End", The Easy Can Company, The Canmaker, Apr. 1998, vol. 11, 5 pages.
"Winter Theme for Toyo's TULC Can", The Canmaker, Dec. 2002, vol. 15, 6 pages.
Bailey, "Making it Easier", The Canmaker, Dec. 1998, vol. 11, 4 pages.
Bailey, "Quality, Not Commodity", The Canmaker, Feb. 2000, vol. 13, 6 pages.
Glendenning, "Ends Are Just the Beginning", The Canmaker, Jul. 2001, vol. 11, 9 pages.
Higuera, "Into the Spotlight", The Canmaker, Jun. 2003, vol. 16, 3 pages.
Nutting, "Canned Convenience", The Canmaker, Sep. 2000, vol. 13, 5 pages.
Nutting, "Corned Beef Comes of Age", The Canmaker, Aug. 2003, vol. 16, 3 pages.
Nutting, "Legendary Success, UK Awards", The Canmaker, Nov. 2003, vol. 16, 4 pages.
Nutting, "Performance Proposal", The Canmaker, Oct. 2000, vol. 13, 4 pages.
Nutting, "The Sweet Aroma of Success", The Canmaker, Jun. 2001, vol. 14, 4 pages.
Nutting, "Thinner, Lighter, Easier", The Canmaker, Nov. 2000, vol. 13, 4 pages.
Nutting, "Uncrowned Champs", The Canmaker, Aug. 2001, vol. 14, 3 pages.
Nutting, "Uphill Struggle", The Canmaker, Jul. 2003, vol. 16, 4 pages.
Page, "The Rigours of Processing", The Canmaker, Jan. 1999, vol. 12, 3 pages.
Pye, "Visible Benefits . . . Easy Does it", The Canmaker, Jun. 1998, vol. 11, 5 pages.
Searle, "A Century of Ends", The Canmaker, Jul. 2006, vol. 19, 4 pages.
U.S. Appl. No.12/615,555, filed Nov. 10, 2009, Wilson
U.S. Appl. No. 61/113,490, filed Nov. 11, 2008, Hall.
Supplementary European Search report dated Jul. 30, 2007, issued in EP patent application No. 03730882, now EP publication No. 1919786.
Definition of "Offset", Webster's New World Dictionary, 3rd College Edition, 1988.

* cited by examiner

METHOD OF FORMING A CAN END HAVING A MOVEABLE PORTION

TECHNICAL FIELD

The present invention relates to a method and tooling for forming a can end. In particular the present invention relates to a method and tooling for forming a can end having enhanced openability.

BACKGROUND

In the field of metal packaging, "easy open" ends for metal cans are well known. Typically, an easy open can end includes a pull tab and an approximately planar panel having a score line defining an opening area. To open a can having an easy open can end, a user may lift a handle of the pull tab to initiate fracture of the score line, and a user may subsequently pull the tab to partially or fully remove a portion of the panel, thereby creating an opening through which a user may access the contents.

Typically, the gap between the pull tab handle and the can end panel is very small. This small gap may make it difficult for a user to grasp the pull tab, because there may not be enough clearance under the pull tab for a user to insert a finger. Therefore, typical easy open cans may be difficult for a user to open.

A can end that has a moveable portion disposed beneath a handle of its tab has been developed by Crown Cork & Seal. This can end—known commercially as the Easylift™ can end—is disclosed in U.S. application Ser. No. 11/613,909, the contents of which are incorporated by reference in their entirety. The Easylift™ can end has a moveable portion that is deformable from an upward position to a downward position. In the upward position, the can end is readily stackable for transportation (i.e. before being attached to a container body), but provides little or no clearance between the can end and the tab. When deformed into the downward position (typically after being attached to a can body), the deformed moveable portion then provides clearance between the tab and can end to enable a user to engage their fingers with the tab and open the can.

While the moveable portion may be deformed into a downward position using a mechanical force, ideally the downward position is achieved utilizing a pressure differential across the can end. For example, before the can end is attached to the can body, the can body is filled with a hot comestible product. After the can end is attached, the hot product cools down gradually and approaches ambient temperature. This lower temperature, as well as resulting steam that is trapped inside the container, may result in a low-pressure period. This reduced pressure inside the container may produce a downward force (i.e. vacuum) acting on the moveable portion to thereby deform the moveable portion into a downward position without the use of a mechanical panel pusher.

Because it is ideal to deform the moveable portion into a downward position utilizing a pressure differential across the can end, there is a need for improved can ends and methods for manufacturing can ends having such capabilities.

SUMMARY

Methods for producing a can end having a moveable portion disposed beneath a tab are disclosed. In one embodiment, a can end having a center panel may be formed. A moveable portion that is moveable between an upward position and a downward position may be formed in the center panel. The moveable portion may be in the downward position after it is formed. The can end may then be restrained by a restraining tool such that a portion of the center panel that is adjacent to the moveable portion is unrestrained. While the can end is restrained, the moveable portion may be moved into the upward position.

In one embodiment the can end may be restrained with a restraining tool having an upper tool and a lower tool. The upper tool may press against an upper surface of the center panel and the lower tool may press against a bottom surface of the center panel. When the restraining tool is restraining the can end, the upper tool may be spaced apart from the portion of the center panel that is adjacent to the moveable portion.

In one embodiment the restraining tool may include an upper tool and a corresponding lower tool. The upper tool may have a first contact surface for contacting a top surface of the can end. The lower tool may have a protrusion and a second contact surface for contacting a bottom surface of the can end. The first and second contact surfaces may press against the can end to thereby restrain the can end. The portion of the center panel that is adjacent to the moveable portion of the center panel may be spaced apart from the upper tool when the can end is restrained by the upper and lower tools. While the can end is restrained, the protrusion may contact an underside of the moveable portion to thereby move the moveable portion from the downward position to the upward position.

These and various other advantages and features are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there are illustrated and described preferred embodiments of the invention.

DETAILED DESCRIPTION OF ILLUSTRATIVE EMBODIMENTS

Preferred structures and methods for can end technology are described herein. An embodiment of a can end and tooling for manufacturing a can end that employ this technology are also described. Further, the present invention encompasses other can end designs not described herein.

Some can ends may have a moveable portion disposed beneath a tab of the can end. The moveable portion is moveable between an upward position and a downward position. Such can ends are preferably manufactured so that the moveable portions are in the upward position. By having the moveable portions in the upward position, the can ends may be more densely stacked for shipment. When the can ends are seamed onto container bodies to thereby form containers, the moveable portions may be moved to the downward position (either mechanically or by utilizing internal negative pressure) so that a gap may be formed underneath their respective tabs. These gaps may allow a user to more easily insert a finger under the pull tabs, to thereby provide enhanced openability of the containers.

Figure 1:
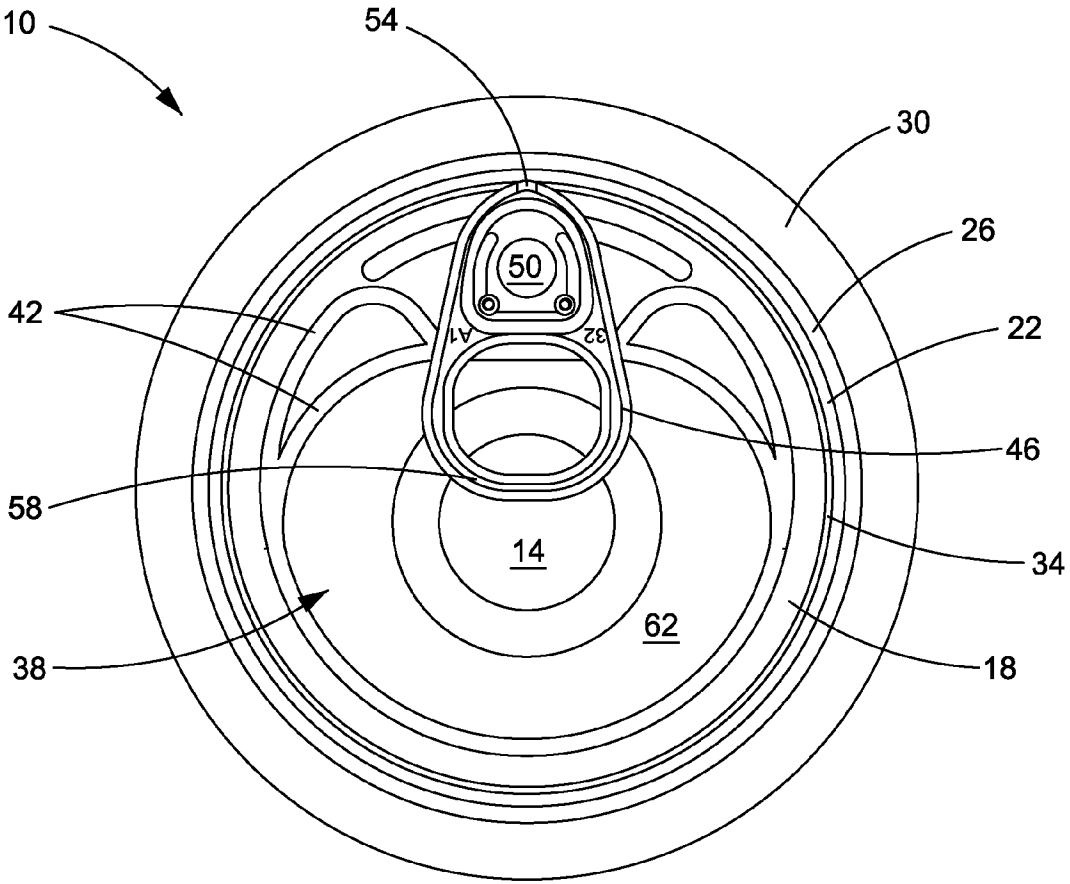
FIG. 1 is a top view depicting an embodiment of a can end having a moveable portion.

FIG. 1 shows a can end 10 having a moveable portion 14. As shown, can end 10 has a center panel 18 with a reinforcing bead 22 at its periphery. Reinforcing bead 22 extends upwardly into a wall 26, with wall 26 extending radially outwards to form a seaming panel 30. A circular score line 34 is formed in can end 10, defining an openable panel portion 38 inwards of score line 34. Score line 34 (once severed) defines an aperture through which a product may be dispensed, with openable panel portion 38 being completely detachable from can end 10. Beading 42 may be provided on center panel 18 for the purpose of strengthening center panel 18.

A tab 46 is attached to center panel 18 by a rivet 50. A first end of tab 46 is provided with a nose portion 54 disposed adjacent to score line 34. The opposite end of tab 46 is provided with a handle portion 58 in the form of a ring.

Figure 2A:
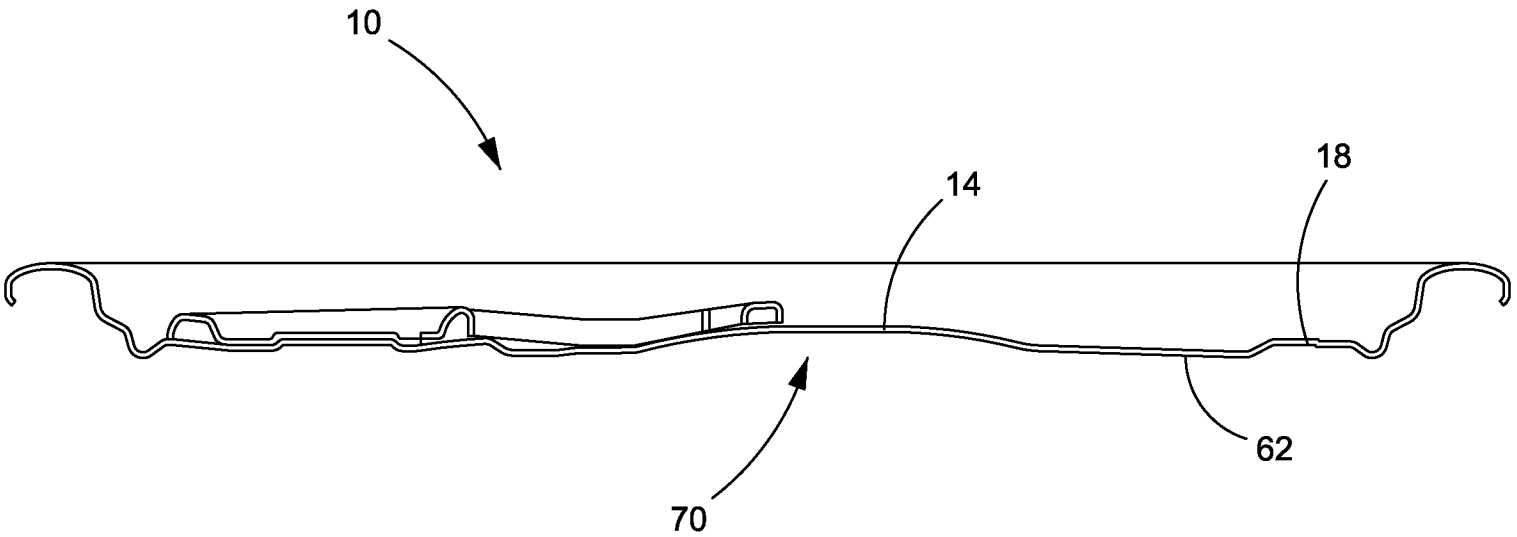
FIG. 2A is a cross sectional view of the can end shown in FIG. 1 with the moveable portion in an upward position.
Figure 2B:
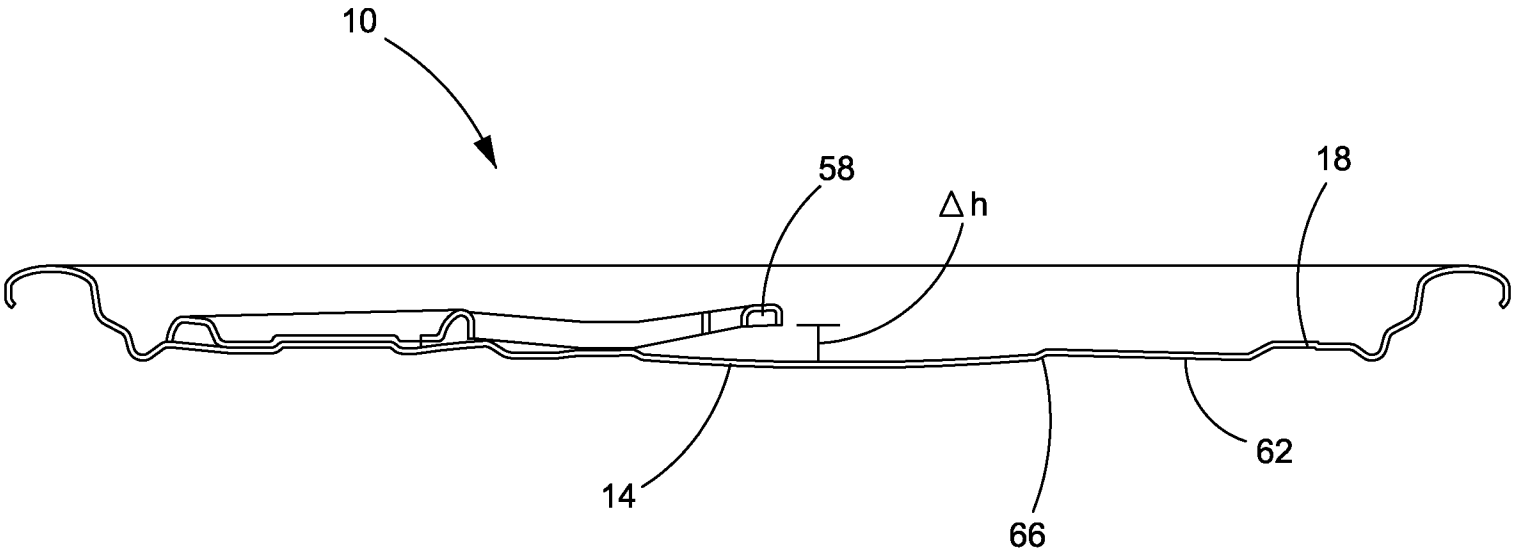
FIG. 2B is a cross sectional view of the can end shown in FIG. 1 with the moveable portion in a downward position.

As shown in FIGS. 1, 2A and 2B, moveable portion 14 may be formed in a recessed portion 62 of center panel 18 and may include a downwardly inclined annular step 66 at its periphery. As shown in FIGS. 2A and 2B, moveable portion 14 can revert between an upward position as shown in FIG. 2A and a downward position as shown in FIG. 2B.

Typically can ends 10 are transported between different sites for later fixing to a can body (i.e. where a filler attaches the can end to the can body). Preferably, moveable portion 14 is in the upward position as shown in FIG. 2A during transport. When in the upward position, moveable portion 14 may have a convex profile that defines a recess 70 on the bottom side of center panel 18. Thus, can ends 10 may be most efficiently stacked when moveable portion 14 is in the upward position, because recess 70 provides space for the tab of an underlying can end.

Once a can body is filled with a product, can end 10 is seamed onto the can body. After seaming, moveable portion 14 may revert back to the downward position. In order to move moveable portion 14 into the downward position, a force may be applied, generally in a downward direction, to moveable portion 14. The force preferably arises from a pressure differential across can end 10, where the pressure on the upper side of can end 10 (outside the container) is higher than the pressure on the lower side of can end 10 (inside the container). In other embodiments, the force may arise from a mechanical force applied to the upper side of moveable portion 14.

When in the downward position as shown in FIG. 2B, moveable portion 14 may have a concave profile that results in a gap $\Delta h$ between handle portion 58 and moveable portion 14. It is intended that a consumer should receive the container with moveable portion 14 in the downward position, because this maximizes tab access and consequently, ease of opening. The presence of annular step 66 may increase the force required for moveable portion 14 to pop-up back to the upward position. That is, annular step 66 may provide assurance against popping-up of moveable portion 14 even when the container is subjected to impacts with adjacent containers or other objects, or transported at high altitudes. In this way, the annular step 66 helps to maintain adequate finger access under the tab 46 for a container incorporating such a can end 10.

In use, a consumer would engage their fingers with handle portion 58 to first lever tab 46 upwardly about rivet 50 to cause nose portion 54 to initiate rupture of score line 34. Thereafter, the consumer may pull back on tab 46 to propagate tearing of the remainder of score line 34 and cause removal of openable panel portion 38 from can end 10.

Can end 10 may be formed of any material such as aluminum or steel. For example, can end 10 may be formed of 0.21 mm gauge DR550N material. The can end 10 may be 73 mm in diameter. FIGS. 3A-3E show can end 10 after each of its forming operations.

Figure 3A:
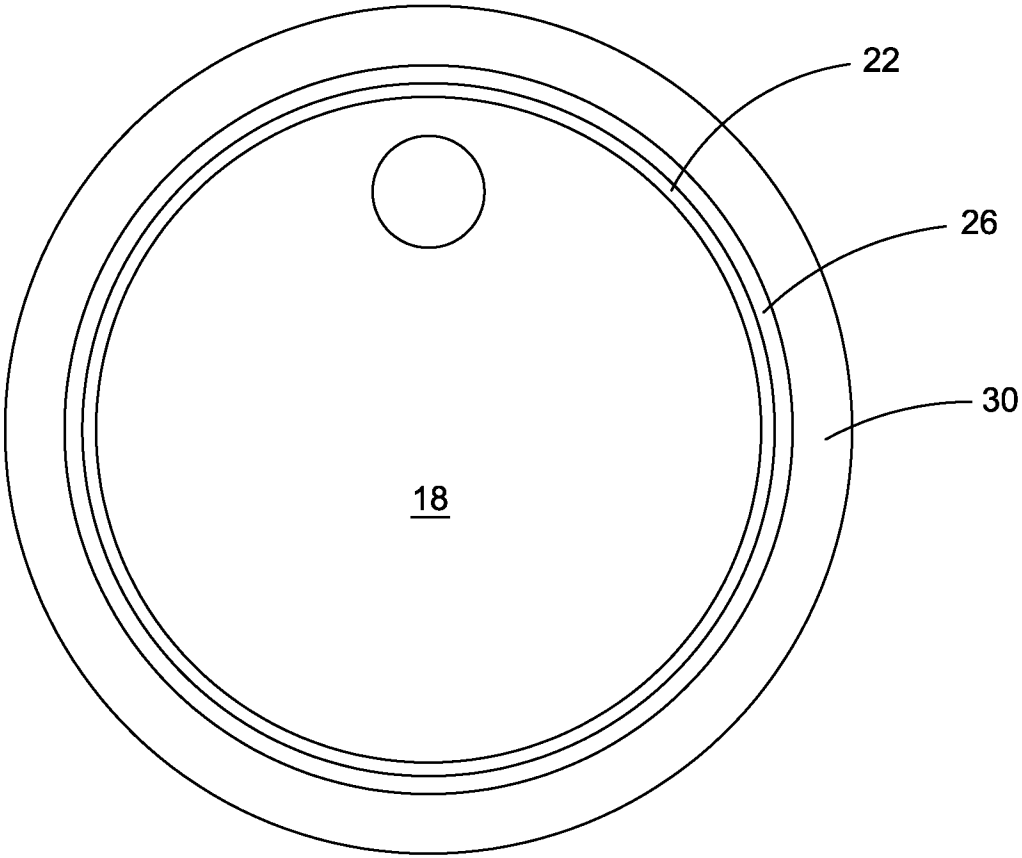
FIG. 3A is a top view depicting a can end after the can end has been formed in a first operation.

As shown in FIG. 3A, after a first forming operation, can end 10 includes center panel 18 with reinforcing bead 22 at its periphery. As shown, reinforcing bead 22 extends upwardly into wall 26, with wall 26 extending radially outwards to form seaming panel 30. At this stage, center panel 18 may be generally planar.

Figure 3B:
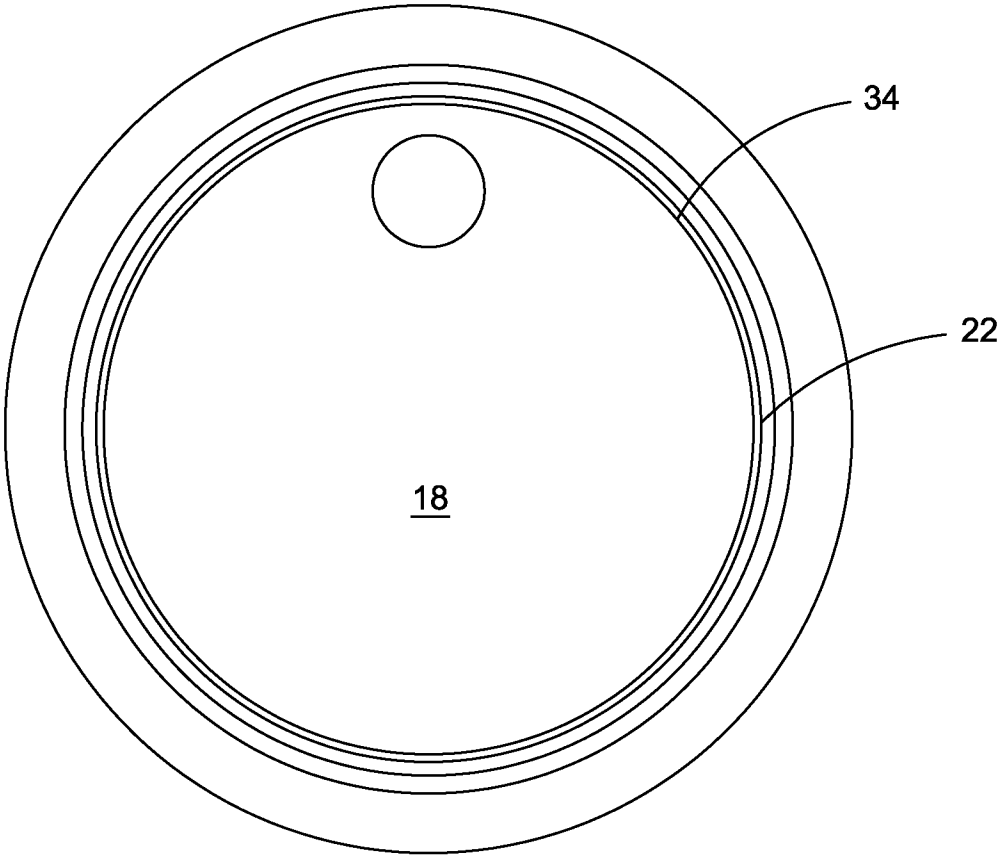
FIG. 3B is a top view depicting the can end of FIG. 3A after the can end has been formed in a second operation.

As shown in FIG. 3B, after a second forming operation, score line 34 is formed in center panel 18 proximate to reinforcing bead 22.

Figure 3C:
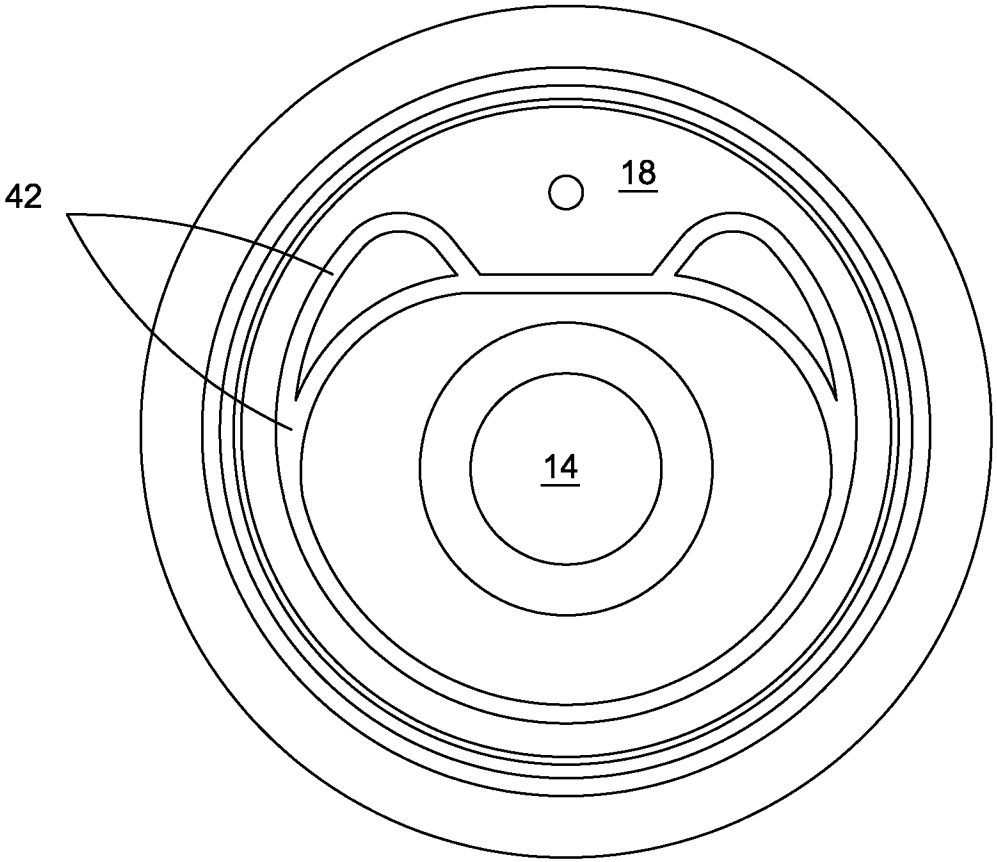
FIG. 3C is a top view depicting the can end of FIG. 3B after the can end has been formed in a third operation.

As shown in FIG. 3C, after a third forming operation, moveable portion 14 and beading 42 are formed in center panel 18. Typically, moveable portion 14 is formed in the downward position as shown in FIG. 2B.

Figure 3D:
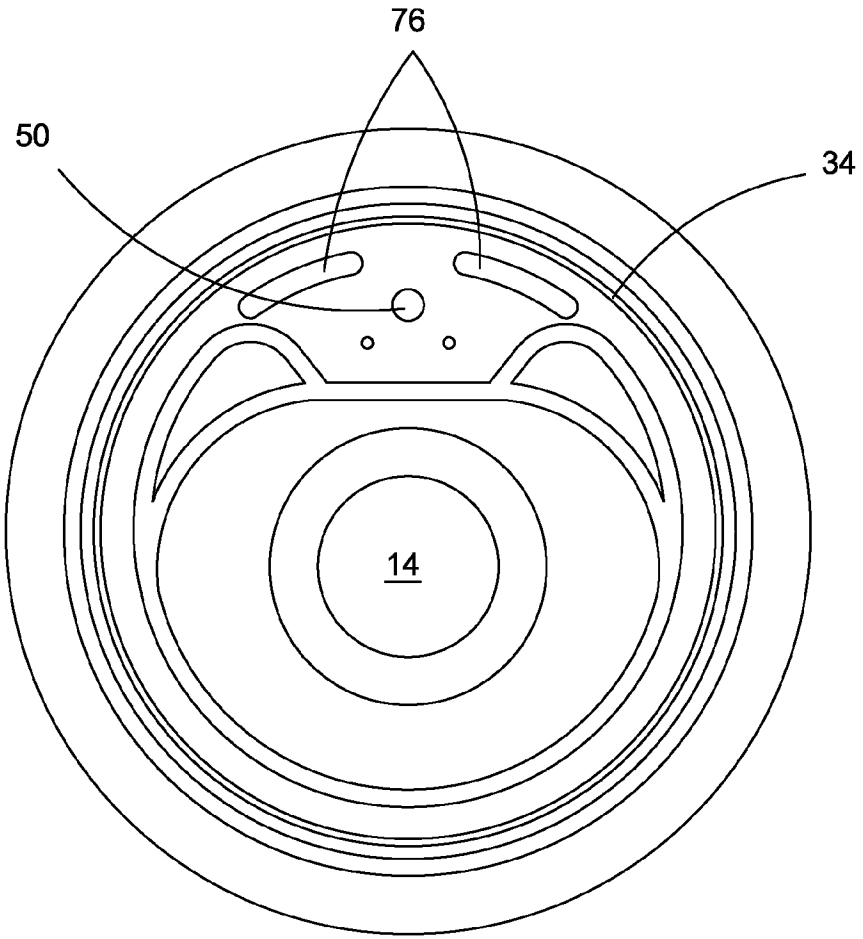
FIG. 3D is a top view depicting the can end of FIG. 3C after the can end has been formed in a fourth operation.

However, because can end 10 is typically transported with moveable portion 14 in the upward position, a fourth operation may be utilized to move moveable portion 14 into the upward position. In that regard, as shown in FIG. 3D, moveable portion 14 is moved into the upward position during the fourth operation. Furthermore, additional beading 76 may be formed in center panel 18 during this operation. As shown, beading 76 may be formed proximate to score line 34 and rivet 50.

Figure 3E:
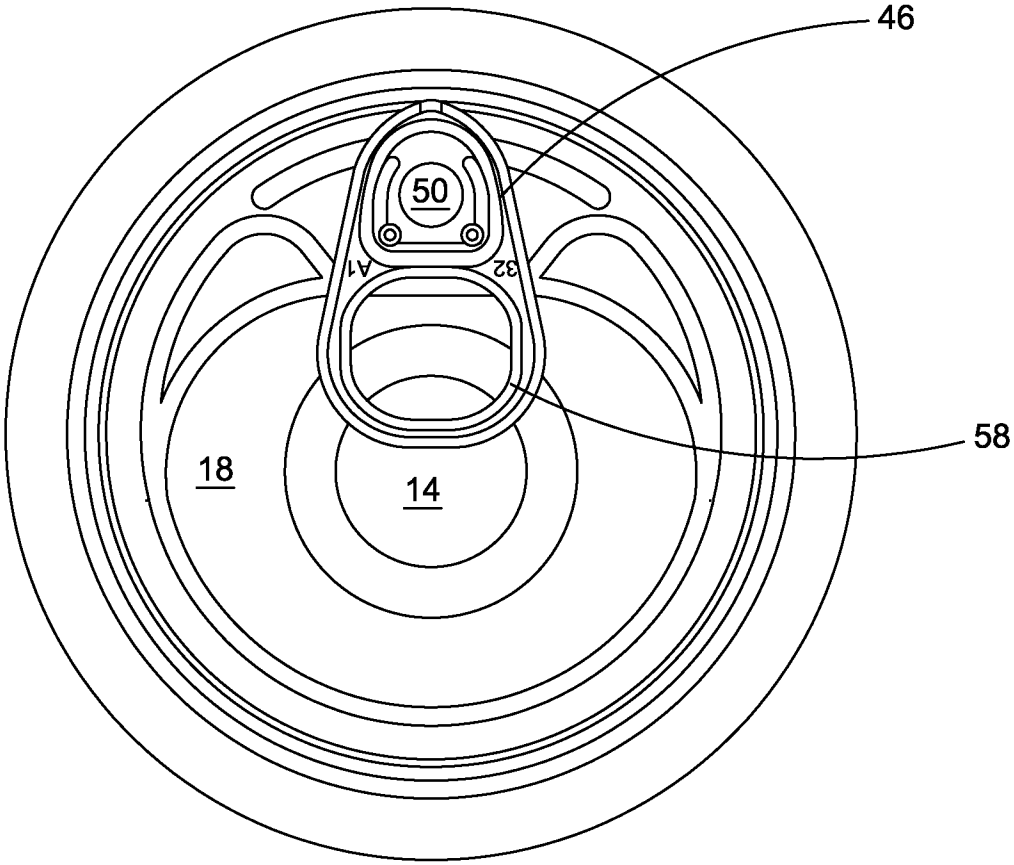
FIG. 3E is a top view depicting the can end of FIG. 3D after a tab has been attached to the can end.

As shown in FIG. 3E, after a fifth operation, tab 46 is attached to center panel 18. As shown, tab 46 may be attached with rivet 50 such that handle portion 58 is located above moveable portion 14. During a sixth operation, burs formed on tab 46 may be removed.

Figure 4:
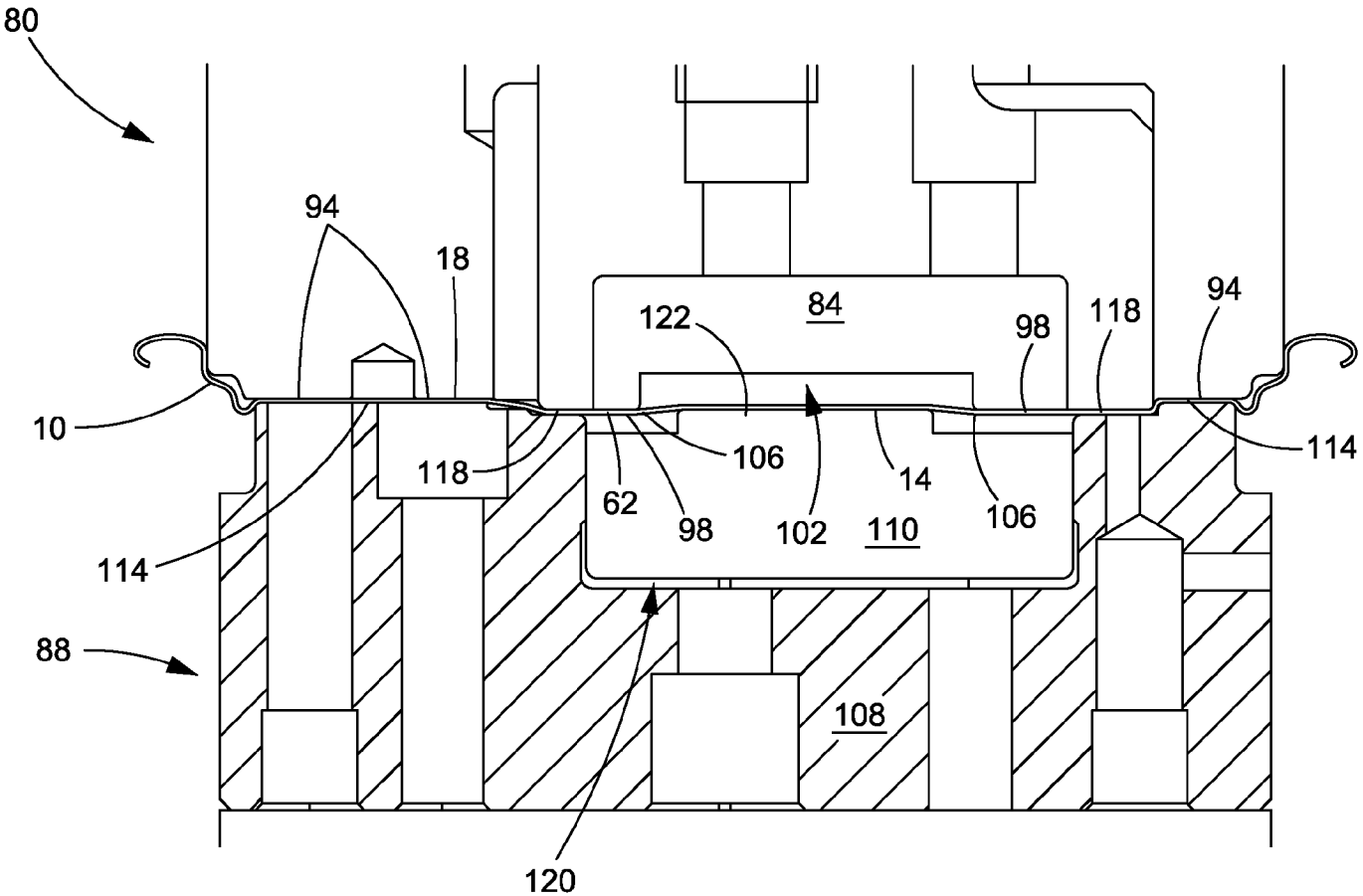
FIG. 4 is a schematic depicting a cross section of a restraining tool having an upper tool and a lower tool that are used during the fourth operation.
Figure 5:
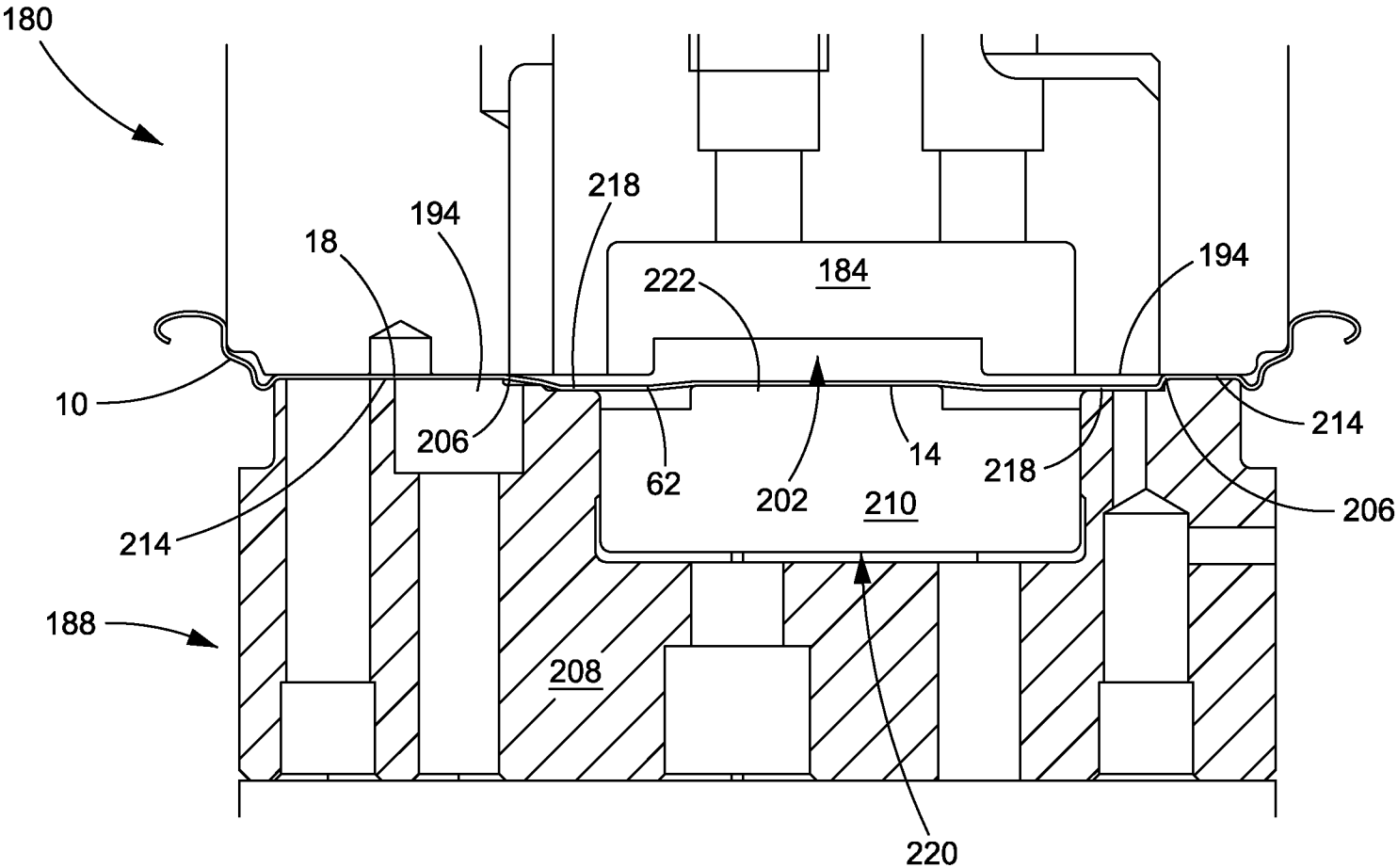
FIG. 5 is a schematic depicting a cross section of another restraining tool having an upper tool and a lower tool that are used during the fourth operation.

During the fourth operation shown in FIG. 3D, in which moveable portion 14 is moved into the upward position, can end 10 is restrained by a restraining tool. Depending on the restraining tool that is used and the manner in which it restrains the center panel 18 of can end 10, the can end may have different operating parameters. That is, the metal may be stretched differently during the fourth operation to thereby create an end that operates differently under similar conditions. FIGS. 4 and 5 depict two different restraining tools that may be used during the fourth forming operation of can end 10.

As shown in FIG. 4, a restraining tool 80 includes an upper tool 84 and a lower tool 88. As shown, can end 10 may be restrained between upper tool 84 and lower tool 88. As can end 10 is restrained, moveable portion 14 formed in center panel 18 is moved to its upward position.

Upper tool 84 includes a first contact surface 94, a second contact surface 98 and a recess 102. First contact surface 94 and second contact surface 98 press against an upper surface of center panel 18 of can end 10. As shown, second contact surface 98 extends further down than first contact surface 94 and contacts the recessed portion 62 of center panel 18, including the portion of center panel 18 directly adjacent to moveable portion 14. Accordingly, when moveable portion 14 is being moved into its upward position, a hinge 106 is created at a point directly adjacent to moveable portion 14.

Lower tool 88 includes a first die 108 and a second die 110. First die 108 includes a first contact surface 114, a second contact surface 118 and a recess 120. First contact surface 114 and second contact surface 118 press against a bottom surface of center panel 18 of can end 10. As shown, second contact surface 118 is lower than first contact surface 114 and contacts a portion of the recessed portion 62 of center panel 18.

Second die 110 is positioned in recess 120 of first die 108. As shown, second die 110 includes a protrusion 122. While can end 10 is being restrained by the respective contact surfaces 94, 98, 114, 118 of the upper tool 84 and lower tool 88, protrusion 122 contacts an underside of moveable portion 14 to thereby move moveable portion 14 into an upward position. Recess 102 defined by upper tool 84 provides clearance for moveable portion 14 when it is in its upward position.

The can end 10 produced using restraining tool 80 contains certain operating parameters. For example, once this can end 10 is seamed onto a can body, a pressure of approximately 600 mbar may be required to move moveable portion 14 into its downward position. Furthermore, once in the downward position a pressure of approximately 600 mbar may be required to move moveable portion 14 back into its upward position.

FIG. 5 depicts another restraining tool that may be used during the fourth operation. The restraining tool of FIG. 5 differs in its mode of operation to that of FIG. 4 in restraining the center panel 18 at a location which is further laterally outward from the moveable portion 14 to that of FIG. 4. As shown, a restraining tool 180 includes an upper tool 184 and a lower tool 188. As shown, can end 10 may be restrained between upper tool 184 and lower tool 188. As can end 10 is restrained, moveable portion 14 formed in center panel 18 is moved to its upward position.

Upper tool 184 includes a first contact surface 194 and a recess 202. First contact surface 194 presses against an upper surface of center panel 18 of can end 10. Compared to the restraining tool 80 of FIG. 4, the upper tool 184 of restraining tool 180 in FIG. 5 restrains the center panel 18 wholly laterally outward of the recessed portion 62 of the center panel. In effect, when using the restraining tool 180 during the fourth operation to move the moveable portion 14 into its upward position, the center panel 18 is less restrained than when using restraining tool 80. When moveable portion 14 is being moved into its upward position using restraining tool 180, a hinge 206 is created at a point radially outward from moveable portion 14.

Lower tool 188 includes a first die 208 and a second die 210. First die 208 includes a first contact surface 214, a second contact surface 218 and a recess 220. First contact surface 214 and second contact surface 218 press against a bottom surface of center panel 18 of can end 10. As shown, second contact surface 218 is lower than first contact surface 214 and contacts a portion of the recessed portion 62 of center panel 18.

Second die 210 is positioned in recess 220 of first die 208. As shown, second die 210 includes a protrusion 222. While can end 10 is being restrained, protrusion 222 contacts an underside of moveable portion 14 to thereby move moveable portion 14 into an upward position. Recess 202 defined by upper tool 184 provides clearance for moveable portion 14 when it is in its upward position.

The can end 10 produced using restraining tool 180 contains certain operating parameters that may differ from the operating parameters of the can end produced using restraining tool 80. For example, once this can end 10 is seamed onto a can body, a pressure of approximately 300 mbar may be required to move moveable portion 14 into its downward position to thereby provide finger access under the tab. Furthermore, once in the downward position, a pressure of approximately 600 mbar may be required to move moveable portion 14 back into its upward position. By producing a can end that only requires approximately 300 mbar to move its moveable portion into a downward position, the potential for sufficient vacuum to cause pop-down without the need for a mechanical panel pusher is increased. Accordingly, the internal negative pressure created by the hot contents of the container may be more efficiently utilized to move the moveable portion into its downward position. This therefore demonstrates a benefit of the reduced restraint provided by using restraining tool 180, as it has the increased potential to avoid the use of a mechanical pusher to move the moveable portion into the downward position to provide finger access under the tab. Examples of methods for using internal negative pressure of a container to move a moveable portion of a can end into its downward position are disclosed in U.S. provisional application No. 61/113,490 titled "Method of Assembling An Easy Open Can End" the contents of which are incorporated by reference in their entirety.

It should be understood that different pressures for moving the moveable portion into its downward position and for moving the moveable portion into its upward position may be required, depending on many factors such as the contents of the can, the manufacturer, and materials used. Regardless, can ends produced using restraining tool 180 may increase the possibility of moving the moveable portion into the downward position without a mechanical pusher. Furthermore, can ends produced using restraining tool 180 are capable of being seamed onto can bodies in high speed seaming operations.

Figure 6:
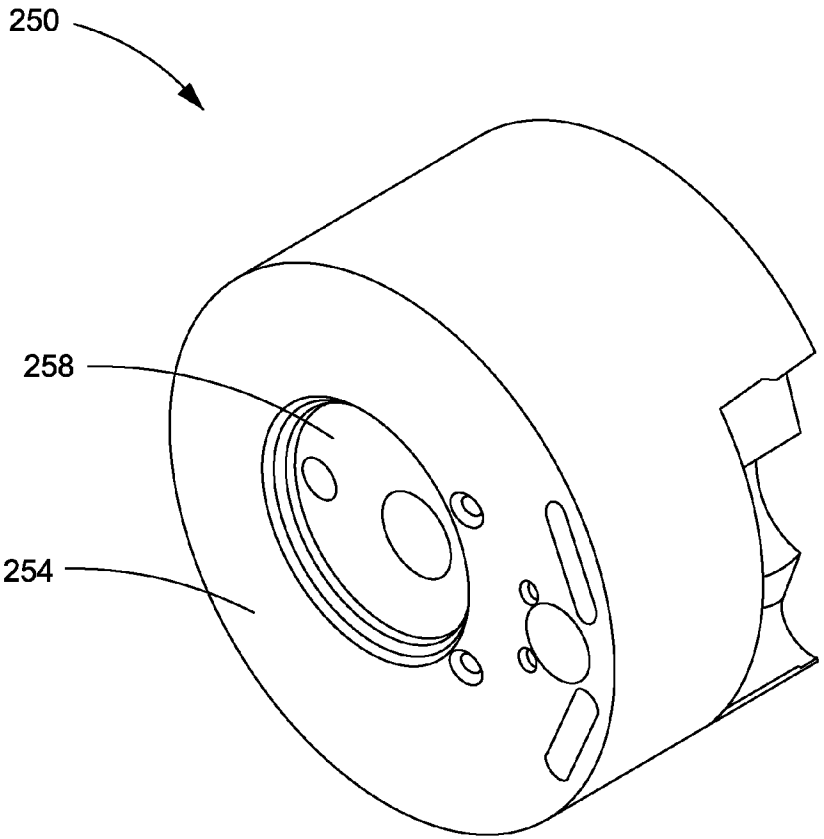
FIG. 6 is a perspective view depicting an upper tool that may be used with the restraining tool shown in FIG. 5.
Figure 7A:
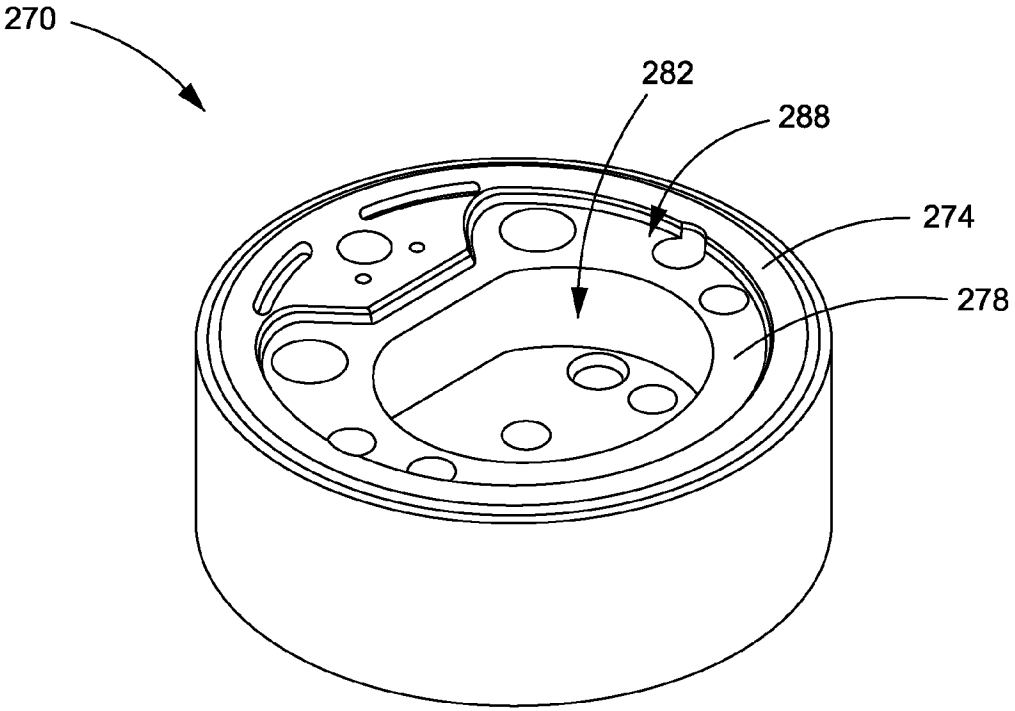
FIG. 7A is a perspective view depicting an embodiment of a first die of a lower tool that may be used with the restraining tool shown in FIG. 5.
Figure 7B:
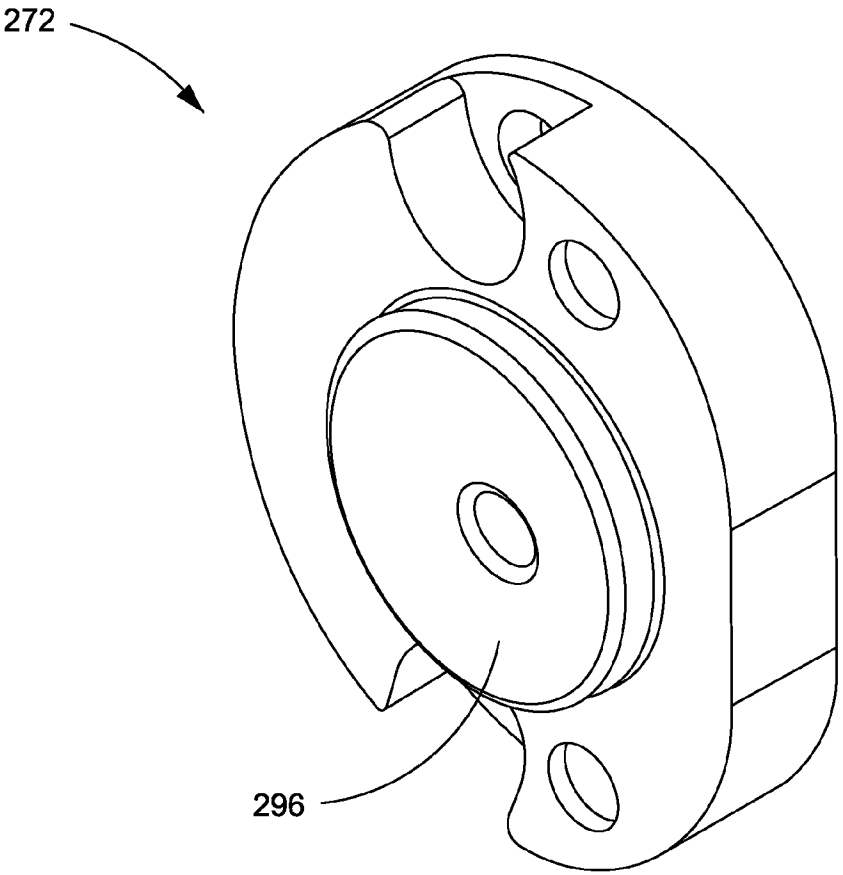
FIG. 7B is a perspective view depicting an embodiment of a second die of a lower tool that may be used with the restraining tool shown in FIG. 5.

FIGS. 6, 7A and 7B disclose example upper and lower tools that may be used for restraining tool 180. Therefore, the upper tool shown in FIG. 6 and the lower tool shown in FIGS. 7A and 7B will be capable of moving the moveable portion of a can end into an upward position while not restraining the portion of the center panel that is adjacent to the moveable portion.

As shown in FIG. 6, an upper tool 250 includes a first contact surface 254 and a recess 258. As shown, recess 258 may be cylindrical and may be surrounded by first contact surface 254. In other words, first contact surface 254 may extend from a peripheral edge of upper tool 250 to recess 258.

FIG. 7A shows a first die 270 of a lower tool and FIG. 7B shows a second die 272 of a lower tool. As shown in FIG. 7A, first die 270 includes a first contact surface 274, a second contact surface 278 and a recess 282. First contact surface 274 may be defined by the upper most surface of first die 270 and second contact surface may be defined by a surface of a second recess 288 formed in first die 270. Second recess 288 may be shaped to receive a recessed portion of a can end 10 so that can end 10 is not damaged during the fourth forming operation. Recess 282 may be formed in second recess 288 and may be shaped to receive or otherwise hold second die 272.

As shown in FIG. 7B, second die 272 may be shaped to fit in recess 282 of first die 270 and includes a protrusion 296. When second die 272 is received by recess 282 of first die 270, protrusion 296 is adapted to contact a bottom surface of a moveable portion of a can end.

The foregoing description is provided for the purpose of explanation and is not to be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Those skilled in the relevant art, having the benefit of the teachings of this specification, may effect numerous modifications to the invention as described herein, and changes can be made without departing from the scope and spirit of the invention as defined by the appended claims. Furthermore, any features of one described embodiment can be applicable to the other embodiments described herein.

What is claimed:

1. A tool for restraining and reforming a can end having a center panel, a reinforcing bead at a periphery of the center panel, and a moveable portion formed in the center panel, the tool comprising:

an upper tool having a first contact surface configured to contact a top surface of the center panel; and a lower tool having a protrusion, and a second contact surface configured to contact a bottom surface of the center panel;

wherein (i) the first and second contact surfaces are configured to press against the center panel to thereby restrain the can end such that a portion of the center panel that is immediately adjacent to the moveable portion of the center panel is spaced apart from the upper tool when the can end is restrained by the upper and lower tools, and (ii) the protrusion is configured to contact an underside of the moveable portion to thereby move the moveable portion from a downward position to an upward position.

2. The tool of claim 1 wherein (i) the upper and lower tools are configured to restrain a center panel of a can end that includes a recessed portion, and a moveable portion that is formed in the recessed portion, and (ii) the first and second contact surfaces are configured to press against the center panel radially outward from the recessed portion.

3. The tool of claim 1, wherein the upper tool includes a recess above the moveable portion of the can end.

4. The tool of claim 1, wherein the is configured to contact an underside of a moveable portion of a can end that is 73 mm in diameter to thereby move the moveable portion from a downward position to an upward position.

5. The tool of claim 1 wherein the protrusion is configured to contact an underside of a moveable portion of a can end that is formed to have a wall portion, an annular reinforcing bead extending radially inward from the wall portion and a center panel that extends radially inward from the annular reinforcing bead.

* * * * *